US005230648A

United States Patent [19]

Kelley et al.

[11] Patent Number: 5,230,648

[45] Date of Patent: Jul. 27, 1993

[54] FOAM DISPENSING DOLL

[75] Inventors: William J. Kelley, Torrance; Daria Pietrowski, Huntington Beach; Robin K. Smith, Long Beach, all of Calif.

[73] Assignee: Mattel, Inc., El Segundo, Calif.

[21] Appl. No.: 929,966

[22] Filed: Aug. 17, 1992

[51] Int. Cl.[5] ..... A63H 3/00; B67D 1/04

[52] U.S. Cl. ..... 446/74; 446/475; 222/78

[58] Field of Search ..... 446/73, 74, 76, 77, 446/475, 268; 222/78

[56] References Cited

U.S. PATENT DOCUMENTS

| | | | |
|---|---|---|---|
| 1,589,138 | 6/1926 | Fisk | 446/73 X |
| 3,105,612 | 10/1963 | Kransoff et al. | 222/78 |
| 3,143,755 | 8/1964 | Rowley . | |
| 3,220,609 | 11/1965 | Russell et al. | 222/78 |
| 3,275,195 | 9/1966 | Reinstra . | |
| 3,388,835 | 6/1968 | Naughten | 222/78 |
| 3,420,412 | 1/1969 | Greene | 222/78 |
| 4,010,870 | 3/1977 | Wilson | 222/78 |
| 4,518,367 | 5/1985 | Zaruba et al. | 446/373 |
| 4,749,104 | 6/1988 | Chao | 222/78 |
| 4,982,874 | 1/1991 | Pringle | 446/475 X |
| 5,071,387 | 12/1991 | Pottick | 446/475 |
| 5,172,863 | 12/1992 | Melone et al. | 222/78 X |

*Primary Examiner*—Mickey Yu

*Attorney, Agent, or Firm*—Roy A. Ekstrand

[57] ABSTRACT

A foam dispensing doll includes a head and body coupled together at a neck joint and defining an interior cavity therein. A generally cylindrical canister sleeve is supported within the doll body and head cavity and extends through a passage formed in the neck joint. The canister sleeve defines a closed end within the doll body and an open end extending upwardly through an aperture formed in the doll head. A generally cylindrical soap canister having a quantity of pressurized soap foam stored therein includes an upwardly extending pivotable valve. The cylindrical soap canister is received within the canister sleeve such that the valve extends upwardly beyond the doll's head. A generally cone-shaped cap is received upon and secured to the soap canister and defines an aperture for discharge of the pressurized soap from the canister interior as well as an access aperture through which the user is able to insert a finger tip and manipulate the valve between open and closed positions to control soap foam dispensing.

6 Claims, 2 Drawing Sheets

FOAM DISPENSING DOLL

FIELD OF THE INVENTION

This invention relates generally to dolls and particularly dolls having product dispensing mechanisms.

BACKGROUND OF THE INVENTION

Dolls and similar toy figures have enjoyed great popularity for many years among children and may perhaps be one of the oldest types of toys in use throughout the world. A virtually endless variety of dolls having different sizes, shapes, configurations, and formed of a great variety of materials have been provides to entertain and amuse young children. Within this variety, dolls have been provided by practitioners in the art which speak, cry, sing and carry on vocal activities of all types. In addition, action dolls have been provided which mimic various human activities such as walking, skating, crawling and the like.

Other types of dolls have been used in combination with product dispensing mechanisms to provide amusing dispensers for products such as candy, toothpaste, soap, shampoo and the like. For example, U.S. Pat. No. 3,105,612 issued Krasnoff et al sets forth an ANIMATED TOY TOOTHPASTE CONTAINER in which a toy figure having an outer appearance corresponding to a sitting dog includes an internal reservoir which receives a quantity of toothpaste. The toy figure is squeezable and includes a dispensing nozzle from which the stored toothpaste is extruded onto a toothpaste as the figure is squeezed.

U.S. Pat. No. 3,143,755 issued to Rowley sets forth a BATHING AID in which a floating figure simulating a whale or fish is formed of a buoyant material and defines an interior reservoir within which a quantity of soap is received. An orifice is formed in the upper surface of the buoyant body and reservoir to permit a quantity of soap to be discharged or dispenses therethrough.

U.S. Pat. No. 3,220,609 issued Russell et al sets forth a DISPENSER having a flexible hollow, generally spherical body supported by a suction cup base. The body further defines a pair of bulging eye-like projections and an extending snout which in turn defines a dispensing passage communicating with the figure's interior. In its intended use, a product such as a liquid is received within the hollow interior and dispensed through the snout by squeezing the generally spherical body.

U.S. Pat. No. 3,275,195 issued to Reinstra sets forth an INTEGRATED HOLDER AND DISPENSER having a toy figure supported toothpaste tube receiving and dispensing mechanism coupled to an aperture in the figure's mouth by a hollow tube. A simulated hat includes a recess and brim for receiving a drinking glass and a plurality of toothbrushes.

U.S. Pat. No. 3,388,835 issued to Naughten sets forth a LOTION AND BUBBLE BATH DISPENSER in which a toy figure is supported in an upright position by a suction cup base. An additional suction cup is positioned at the rear torso of the figure to permit attachment to a vertical surface. The head portion of the figure is carried on a movable pump shaft which is coupled to a pivotal arm mechanism whereby the liquid such as soap or the like is dispensed as the arm and head are moved.

U.S. Pat. No. 4,010,870 issued to Wilson sets forth a TOOTHPASTE DISPENSER AND CONTAINER having a human-like figure defining an interior cavity within which a quantity of toothpaste is received. A dispensing passage couples the interior with a dispensing nozzle formed in one hand of the figure. A quantity of toothpaste is dispensed outwardly from the interior container through the arm and nozzle defined therein.

U.S. Pat. No. 4,518,367 issued to Zarupa et al sets forth a FIGURE INCLUDING MEANS FOR EXTRUDING PLASTIC SUBSTANCE in which a ghost-like humanoid figure includes a skeletal face coupled to a supply of extrudable material such as molding compound or the like. A plurality of facial masks are provided which generally conform to, but are larger than, the skeletal face. In its intended play pattern, the mask is placed upon and surrounds the skeletal head and face after which the molded material is extruded through apertures in the skeletal face to fill the space separating the skeletal head and face from the mask. The mask is then removed to show a head and face molded upon the skeletal head.

U.S. Pat. No. 4,982,874 issued to Pringle sets forth a SHAMPOO DISPENSING CONTAINER having a generally human action figure and including a fluid pumping system operative to dispense shampoo from the container's interior in an exploding type pattern as one of the arms of the figure is moved.

U.S. Pat. No. 5,071,387 issued to Pottick sets forth a FIGURINE-SHAPED WATER SQUIRTING TOY having a hollow interior within which a quantity of liquid is received. A pumping mechanism within the interior is operative to discharge the liquid outwardly through a mouth aperture. An operative mechanism couples one movable arm of the figure to the pump mechanism such that the pump is operated as the arm is moved.

U.S. Pat. No. 4,749,104 issued to Chao sets forth a MULTI-PURPOSE CLEANSING LIQUID DISPENSER which includes a hollow fuselage or body configured in a fanciful shape such as that of an airplane or rocket. A suction cup is secured to the body to permit attachment to a vertical surface. An internal reservoir within the body receives a quantity of dispensable liquid such as soap or the like which is dispensed outwardly through the lower portion of the body.

While the foregoing described pump devices have provided varying degrees of amusement and utility, there remains nonetheless a continuing need in the art for evermore interesting, amusing and entertaining dolls and toy figures which utilize the play pattern of dispensing an internally stored material.

SUMMARY OF THE INVENTION

Accordingly, it is a general object of the present invention to provide an improved doll. It is a more particular object of the present invention to provide an improved doll capable of dispensing a foam material.

In accordance with the present invention, there is provided a foam dispensing doll comprises a doll body defining an internal body cavity, a doll head defining an interior head cavity and aperture, a neck joint coupling the head to the body, a canister sleeve, defining an interior canister passage and an open end is generally aligned with the aperture, a soap canister receivable within the canister passage having a valve extending upwardly from the head, and a cap coupled to the canister having a cap interior for receiving the valve and defining a nozzle aperture and a finger aperture, the valve being operable by a user fingertip inserted through the finger aperture to move the valve and discharge soap from the canister through the nozzle aperture.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
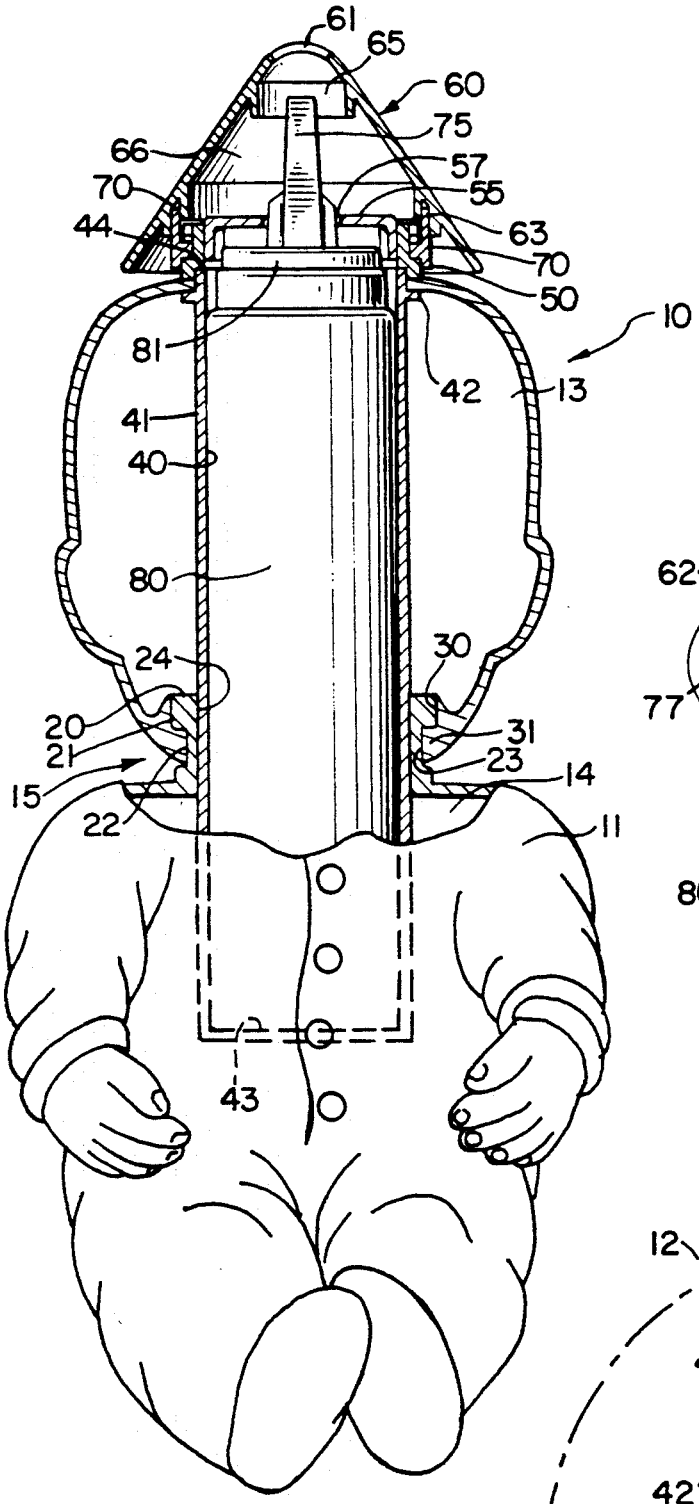
FIG. 1 sets forth a partially sectioned front view of a foam dispensing doll constructed in accordance with the present invention.

FIG. 1 sets forth a partially sectioned view of a foam dispensing doll constructed in accordance with the present invention and generally referenced by numeral 10. Doll 10 includes a body 11 configured to generally replicate a human infant and a corresponding head 12. Head 12 is preferably formed of a molded plastic material or the like and defines an interior cavity 13. Body 11 defines an interior cavity 14. Head 12 and body 11 are joined at a neck joint 15 which comprises an upwardly extending generally cylindrical neck riser 20 preferably integrally formed with body 11 and defining a groove 22 and an outwardly extending lip 21. Correspondingly head 12 defines a neck aperture 23 having a recess 30 and an inwardly extending lip 31 formed therein. Neck joint 15 is completed by the insertion of neck riser 20 into interior cavity 13 of head 12 such that lip 31 of head 12 is received within groove 22 of neck riser 20 and lip 21 of neck riser 20 is received within recess 30 of head 12.

Head 12 further defines an aperture 32 formed in the top surface thereof. An elongated generally cylindrical canister sleeve 40 defines a cylindrical interior passage 41, a closed end 43, and an outwardly extending lip 42. Canister sleeve 40 is received within interior cavities 13 and 14 of body 11 and passes through passage 24 of neck riser 20 and aperture 32 of head 12.

A pressurized soap canister 80 having a generally cylindrical body is sized to fit easily within interior passage 41 of canister sleeve 40. Soap canister 80 includes a valve support 81 having a movable dispensing valve 75 coupled thereto. In accordance with conventional fabrication techniques, valve support 81 and valve 75 are operable to discharge the pressurized foam soap contents within soap canister 80. It will be recognized by those skilled in the art that a variety of pressurized soap canisters may be utilized within doll 10 without departing from the spirit and scope of the present invention. With soap canister 80 received within interior passage 41 of canister sleeve 40, a portion of canister sleeve 40 extends upwardly beyond the top surface of head 12. An annular lock ring 50 is received upon the extending portion of canister sleeve 40 in a snap fit attachment. An annular spacer 70 is received upon and snap fitted to the outer surface of lock ring 50. A generally conical cap 60 defines a nozzle aperture 61 at its apex and a downwardly extending nozzle passage 65. Cap 60 further defines an interior cavity 66 and an annular groove 63. The upper portion of spacer 70 is received within annular groove 63 to secure cap 60 to spacer 70. In its preferred form, an adhesive material or other bonding agent is utilized to secure the upper portion of spacer 70 within groove 63. A cap receptacle 55 is received within lock ring 50 and defines an aperture 57 having a generally rectangular shape. Valve 75 is pivotally secured within valve support 81 in accordance with conventional fabrication techniques and, in the assembled position shown in FIG. 1, extends upwardly through aperture 57 of cap receptacle 55. Valve 75 also extends partially into nozzle passage 65 within cap 60.

Thus in the assembled position shown, soap canister 80 is received and generally concealed within interior passage 41 of canister sleeve 40 within interior cavities 13 and 14 of head 12 and body 11, respectively. In addition, valve support 81 and valve 75 are, for the most part, concealed within cap 60. In its preferred form, cap 60 is shaped to generally replicate a hat or head adornment and may, as desired, support additional accessory items such as a party hat or other hat configuration or the like.

In accordance with the play pattern set forth below in greater detail, the child user is able to access valve 75 through a finger aperture 62 defined by cap 60 (seen in FIG. 2) and in the manner described below in FIG. 3 in greater detail, manipulate valve 75. As valve 75 is manipulated, the pressurized soap foam within canister 80 is released upwardly through valve 75 and outwardly from cap 60 through passage 65 and nozzle aperture 61. Thus, the soap foam emerges through aperture 61 of cap 60 and thereafter tends to build up on either side of cap 60. Thus, the foaming soap building up about cap 60 simulates a quantity of shampoo being utilized upon head 12 of doll 10. Alternatively, doll 10 may be used to provide a convenient soap dispenser for use by the child user. When so used, the pressurized character of soap canister 80 permits the pressurized discharge of soap foam in a variety of doll positions.

Figure 2:
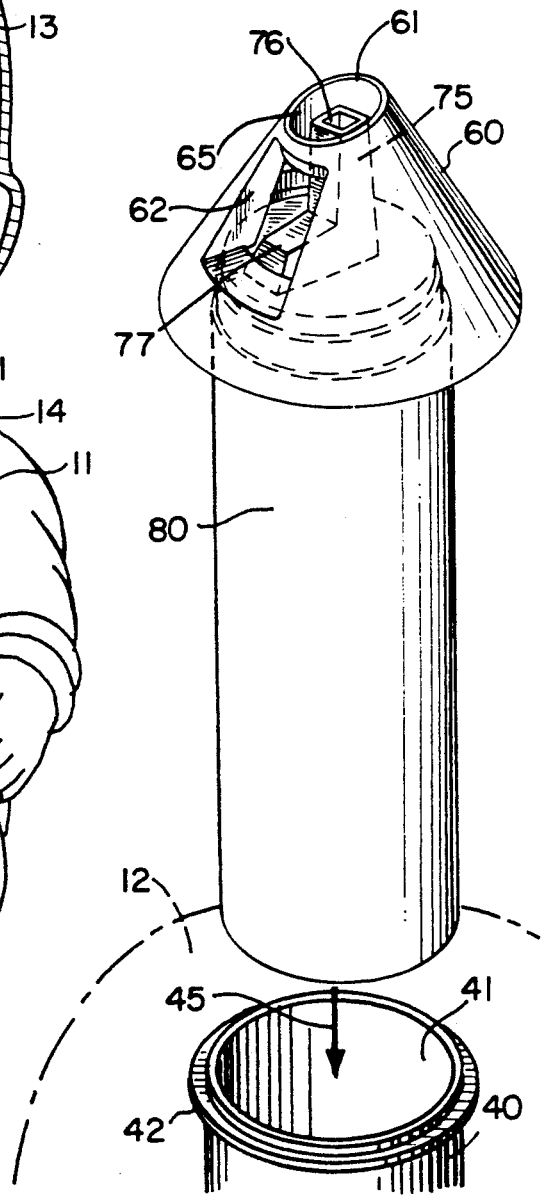
FIG. 2 sets forth a perspective view of the foam dispensing portion of the present invention doll.

FIG. 2 sets forth a perspective assembly view of the soap canister and cap portion of the present invention during assembly within doll 10. As described above, head 12 supports a generally cylindrical canister sleeve 40 having an outwardly extending annular lip 42 and an upwardly extending upper edge portion 44. Canister sleeve 40 defines a closed end interior passage 41 having a diameter sufficient to receive a generally cylindrical foam soap canister 80. Canister 80 is coupled to a conical cap 60 in the above-described manner and is assembled to doll 10 by the insertion of canister 80 downwardly into interior passage 41 in the direction indicated by arrow 45. Once canister 80 is received within interior passage 41, the snap fit attachment between lock ring 50 (seen in FIG. 1) and upper edge 44 of canister sleeve 40 provides a removable attachment between soap canister 80 and doll 10. As can be seen, cap 60 may be preassembled to soap canister 80 to facilitate this assembly. Cap 60 defines a generally conical outer surface and terminates in a nozzle aperture 61 and a downwardly extending nozzle passage 65. Cap 60 further defines an interior cavity 66 which receives the upper extension of valve 75. Valve 75 is constructed in accordance with conventional fabrication techniques and defines an upwardly extending valve passage 76 and a laterally extending ledge 77. As is set forth below in greater detail, the pivotal motion of valve 75 with respect to valve support 81 (seen in FIG. 3) permits the discharge of soap foam from the interior of canister 80 outwardly through valve passage 76.

Cap 60 further defines a generally rectangular finger aperture 62 aligned with ledge 77 of valve 75. As a result of this alignment, the child user is able to actuate valve 75 by extending a finger tip through aperture 62 to place a downward pressure upon ledge 77. The downward pressure upon ledge 77 pivots valve 75 in the manner shown in FIG. 3 in greater detail to dispense a quantity of soap foam from canister 80.

In accordance with an important aspect of the present invention, soap canister 80 may be depleted and thereafter removed from canister sleeve 40 and cap 60 and discarded. A replacement soap canister may then be substituted for canister 80 and secured to cap 60 for assembly into canister sleeve 40 thereby renewing the foaming action of doll 10.

Figure 3:
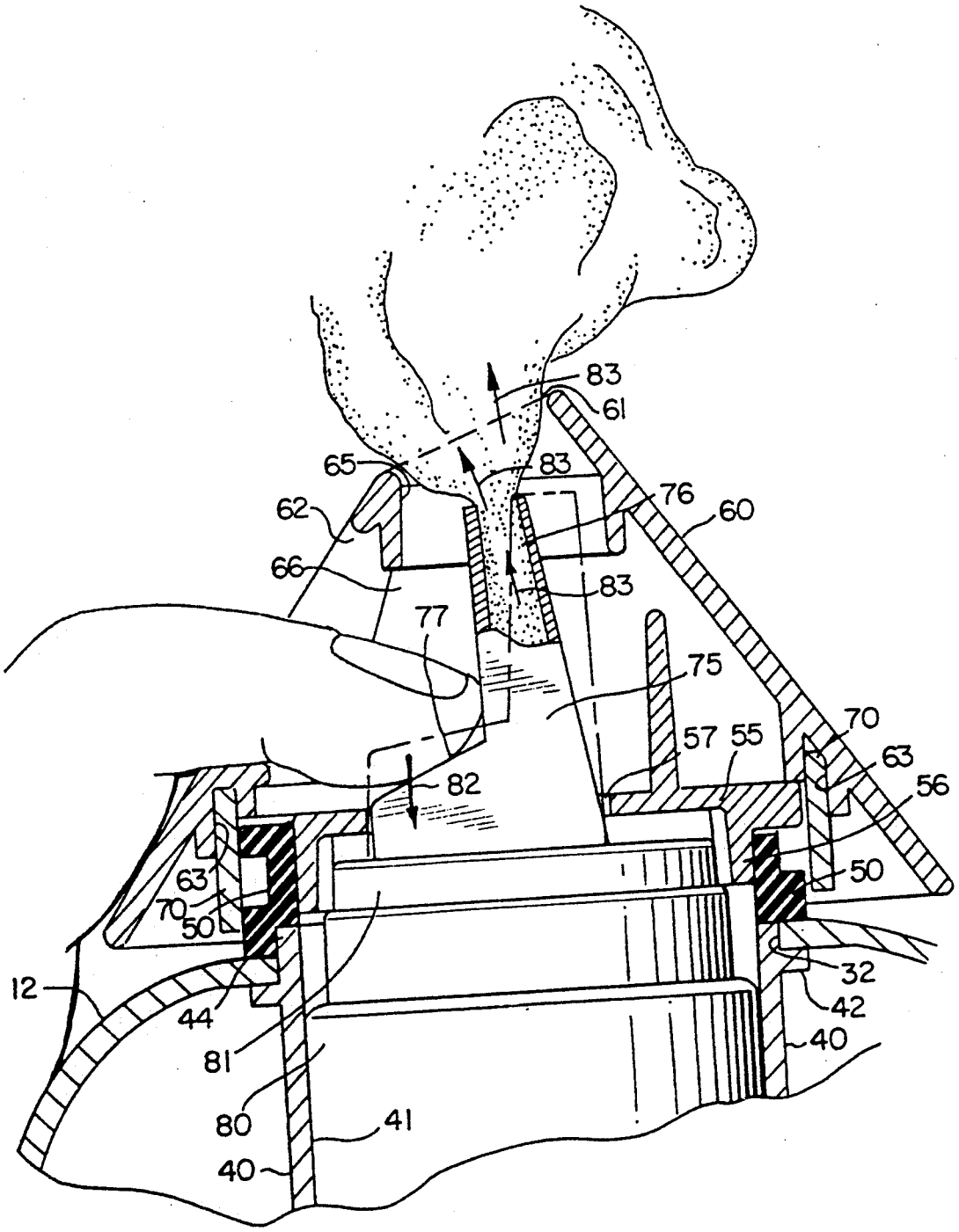
FIG. 3 sets forth a partial section view of the present invention foam dispensing doll in operation.

FIG. 3 sets forth a partial section view of the foam dispensing portion of the present invention doll. As described above, doll 10 includes a head 12 defining an interior cavity 13 and an aperture 32. A generally cylindrical canister sleeve 40 defines an interior passage 41 and an outwardly extending lip 42. Canister sleeve 40 further defines an upper edge 44 which extends through aperture 32 of head 12.

An annular lock ring 50 is received upon upper edge 44 in a snap fit attachment. A cap receptacle 55 defines a downwardly extending annular flange 56 which is received within lock ring 50. An annular spacer 70 is secured to lock ring 50 and is received within an annular groove 63 formed within cap 60. Cap 60 defines a generally conical shape having an interior cavity 66 and nozzle aperture 61 formed therein. A nozzle passage 65 extends downwardly from nozzle aperture 61 of cap 60.

A soap canister 80 defines a generally cylindrical body received within interior passage 41 of canister sleeve 40 in the manner described above. Soap canister 80 further includes a valve support 81 and a pivotally supported valve 75. The pivotal attachment of valve 75 within valve support 81 is fabricated in accordance with conventional fabrication techniques (not shown). Cap receptacle 55 defines a rectangular aperture 57 through which valve 75 extends upwardly into interior cavity 66 of cap 60. Valve 75 defines a valve passage 76 and an angularly extending ledge 77. As described above, valve 75 and cap 60 are mutually aligned such that aperture 62 of cap 60 provides access to ledge 77 of valve 75. As a result, the user is able to manipulate valve 75 by extending a finger tip through aperture 62 and against ledge 77 in the manner shown in FIG. 3. Thereafter, a downward pressure upon valve 75 in the direction indicated by arrow 82 pivots valve 75 from the dashed line normal position shown in FIG. 3 to the angularly disposed position shown in solid line representation. By conventional valve means (not shown), the pivotal movement of valve 75 opens valve 75 permitting the discharge of pressurized foam soap from the interior of soap canister 80 upwardly through valve passage 76 in the direction indicated by arrows 83 to produce a foam discharge through nozzle passage 65 and nozzle aperture 61 of cap 60.

Upon the release of finger pressure against ledge 77 of valve 75, valve 75 returns to the dashed line position shown resulting in closure of valve 75 and terminating the discharge of foam material. This process is continued by the user as desired until the supply of pressurized foam soap within canister 80 is exhausted. As described above, once the quantity of foam soap within canister 80 has been exhausted, it may be removed from canister sleeve in the manner described and replaced to continue the play pattern.

What has been shown a foam dispensing doll having an interior receptacle which receives a pressurized foam soap canister and valve combination. A simulated cap is securable to the soap canister and provides access to the valve permitting the user to manipulate the canister valve and selectively discharge a quantity of foam soap from the pressurized canister. The simulated cap and doll body cooperate to cover and conceal both the pressurized foam soap canister and the valve mechanism to provide an interesting and attractive doll configuration. The soap canister may be removed and replaced to replenish the supply of foam soap within the dispensing doll.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

What is claimed is:

1. A foam dispensing doll comprising:
a doll body defining an internal body cavity;
a doll head defining an interior head cavity and aperture;
a neck joint coupling said head to said body;
a canister sleeve, defining an interior canister passage and an open end received within said head cavity and supported such that said open end is generally aligned with said aperture;
a soap canister receivable within said canister passage having a valve extending upwardly from said head; and
a cap coupled to said canister having a cap interior for receiving said valve and defining a nozzle aperture and a finger aperture;
said valve being operable by a user fingertip inserted through said finger aperture to move said valve and discharge soap from said canister through said nozzle aperture.

2. A foam dispensing doll as set forth in claim 1 wherein said neck joint defines a neck passage therethrough and wherein said canister sleeve extends through said neck passage into said head cavity and body cavity.

3. A foam dispensing doll as set forth in claim 2 wherein said canister sleeve, said canister passage and said soap canister are generally cylindrical.

4. A foam dispensing doll as set forth in claim 3 wherein said cap includes attachment means for assembling said cap to said soap canister independent of said doll.

5. A foam dispensing doll as set forth in claim 4 wherein said valve is pivotally operated.

6. A foam dispensing doll as set forth in claim 5 wherein said cap defines a generally frusto conical outer surface having said nozzle aperture positioned at the apex thereof.

* * * * *